US005664691A

United States Patent [19]

Boivin-Paradis

[11] Patent Number: 5,664,691

[45] Date of Patent: Sep. 9, 1997

[54] MULTIPURPOSE MODULAR ORGANIZER

[76] Inventor: Jacqueline Boivin-Paradis, 2726, Rue Verrier, Sainte-Foy, Québec, Canada, G1V 1G6

[21] Appl. No.: 511,370

[22] Filed: Aug. 4, 1995

[30] Foreign Application Priority Data

Aug. 9, 1994 [CA] Canada ..... 2129800

[51] Int. Cl.[6] ..... A47F 5/00

[52] U.S. Cl. ..... 211/184; 211/43; 211/175

[58] Field of Search ..... 211/43, 184, 175, 211/11; 108/61

[56] References Cited

U.S. PATENT DOCUMENTS

| | | | |
|---|---|---|---|
| 1,379,790 | 5/1921 | Waterhouse | 211/11 |
| 1,768,379 | 6/1930 | Smith | 211/43 X |
| 1,891,420 | 12/1932 | Jaquith | 211/43 |
| 3,171,542 | 3/1965 | Jacobs et al. | 211/43 |
| 3,285,429 | 11/1966 | Propst | 211/43 X |
| 3,300,057 | 1/1967 | Wheaton | 211/184 |
| 3,780,876 | 12/1973 | Elkins | 211/184 |
| 4,395,955 | 8/1983 | Pfeifer | 211/184 X |
| 4,438,852 | 3/1984 | Evans | 211/11 |
| 5,072,835 | 12/1991 | Price et al. | 211/184 X |
| 5,287,974 | 2/1994 | Buday | 211/43 X |

FOREIGN PATENT DOCUMENTS

| | | |
|---|---|---|
| 538615 | 3/1957 | Canada . |
| 653021 | 11/1963 | Canada . |
| 48940 | of 1940 | Netherlands . |

*Primary Examiner*—Robert W. Gibson, Jr.

[57] ABSTRACT

A new article support system for household and commercial uses, for setting adequately in order handbags, purses, shoes and other personal effects, especially for articles which are fabricated of a supple material and are generally of a shape which does not permit holding vertically by themselves without being held on either side or from both sides at once. A base plank frame is provided with matching means allowing the adding of successive planks. Dividers with L-shaped hooks are set perpendicularly of the plank, to run longitudinally of the plank, to provide proper spacing for size of objects which one desires to store. The sides of the plank have a sufficient thickness to provide a structure to embrace the opening of the hooks. When the unit is set vertically, the divider is set horizontally, and while being supported as a cantilever and being tightly fitted, it automatically locks itself in position.

10 Claims, 6 Drawing Sheets

MULTIPURPOSE MODULAR ORGANIZER

BACKGROUND FIELD OF THE INVENTION

The present invention belongs to the field of storing articles of different shapes, height and thickness which cannot be stored suitably without being laterally supported, to hold vertically. More specifically, nonetheless, this invention deals with solving the storing problems of purses and handbags, mainly in storing in cupboards or in residence in closets. It is multipurpose for home and commercial applications and modular in conception to permit unlimited extension.

PRIOR ART

Different storing systems have already been patented or actually exist on the market such as: storing systems for audio tapes or videos, modular office systems for the storing of documents: cards, folders and others, some storing systems for books and other more rigid articles in libraries or in the offices or for different articles needing to be supported, or for some merchandise in stores.

A patent search revealed some patents with one or more partitions and a base plate arranged to support books or for files within office cabinets and drawers.

NE 48940, Alderliefste, 1940 who discloses an extended base, with one divider, with a C shaped clip which grasps a roller traveling within the sides of the base, the contact with the sides of the base being the roller, which is a large longitudinal support, and which takes up space at the end of the base and does not allow the adding a of extra partitions.

CAN 653,021, Metzler, 17 Nov. 1963 discloses several dividers, but with an angulated end support, and with a base adapted to rest horizontally. The structure on beneath which hides the sides of each divider is a re-entrant channel, tightened by screws. A large number of parts are necessary to achieve locking in position.

CAN 538,615, Lévesque, 26 Mar. 1957 discloses end supports, the space taken by the end supports reducing the overall storage capacity.

No intermediary dividers are provided.

U.S. Pat. No. 4,438,852, Evans, 15 Jun. 1981, discloses a union piece which takes the shape of a wide L to match an edge of a base plank with the edge of a crosswise laid other smaller base plank, each base plank supporting fixed position dividers. The union piece is long to tighten into place and it does not suggest any continuity.

All the systems mentioned above have a similar default, that is if not to be totally unadjustable, they cannot be easily adjustable to the thickness of an article which one wishes to store. Most known systems have been developed for the storing of precise objects, so that the adjustment of different dividers cannot easily be performed at the time of the initial assembly of the systems of the Prior Art. In such cases, the adjustment of the dividers becomes too laborious to be used advantageously by an individual to store its personal effects.

OBJECTIVES OF THE INVENTION

A general objective of the present invention is to provide a storing unit which has the benefit of self adjusting in a few seconds according to the desired spacing which corresponds to the thickness of the article which one wishes to store, and making sure the structure of the storing unit is stable for its long term use, especially that the support function of the system does not deteriorate with use.

The storing unit is fabricated of light and flexible plastic material according to a format which permits to be used as a storing unit in most of cupboards, closets, wardrobes, office shelves, filing cabinets and drawers, especially for expandables files and generally in most places where it is appropriate to store some articles necessitating any lateral support for vertical holding. It may be of wood, metal or other suitable material. Though designated under the name "Purse Rack" all users will rapidly detect that this storing system can be used for many applications nonetheless, serve for the storage for all articles having diverse and non uniform dimensions, those articles being of relatively light weight. Among articles in those categories one finds handbags, purses, some books, files, all dimensions of audio tapes, all sizes of Tupperware lids, etc., and especially for vertical storing: some towels, tuques, gloves, scarves, headgear, stockings, sandals and other articles relatively light.

SUMMARY OF THE INVENTION

A multipurpose modular storage unit, for various articles of different shapes and configurations, comprising in combination:

a number of C-shaped dividers, comprising a web and two wings, the web having a central axis passing centrally between the wings and the web taking any shape of geometric figure, the wings being provided with L-shaped hooks protruding therefrom, the L-shaped hooks being oriented towards the central axis;

a support floor having two first and second ends and two side edges each side edge having a heavy section, the C-shaped dividers being installed transversely of the support floor with the L-shaped hooks slidingly straddling the heavy section of the side edges.

The support floor comprises a length l, a first width w and a depth d, the length comprising a starting section, starting at the first end, an end section ending at the second end, and a number of intermediary sections, each intermediary sections comprising a trailing edge, a leading edge and part of the two side edges, the leading edge tightly inserted into the trailing edge to reach profoundly a distance p into the corresponding trailing edge.

The web is rectangular and has a height h and a second width w', the second width corresponding to the distance between the side edges, the height being of the order of from 20 to 80% of the width, the divider having a thickness e, the height being provided with two summits, one superior summit being rounded and an inferior summit carrying the L-shaped hook, of equal thickness e and oriented towards the direction of the width, each corresponding L-shaped hook being oriented towards the other.

DESCRIPTION OF THE INVENTION

I will describe more in details hereinafter by way of an indication, nonetheless limiting, an apparatus true to the present invention in reference to the annexed drawing on which:

Figure 4:
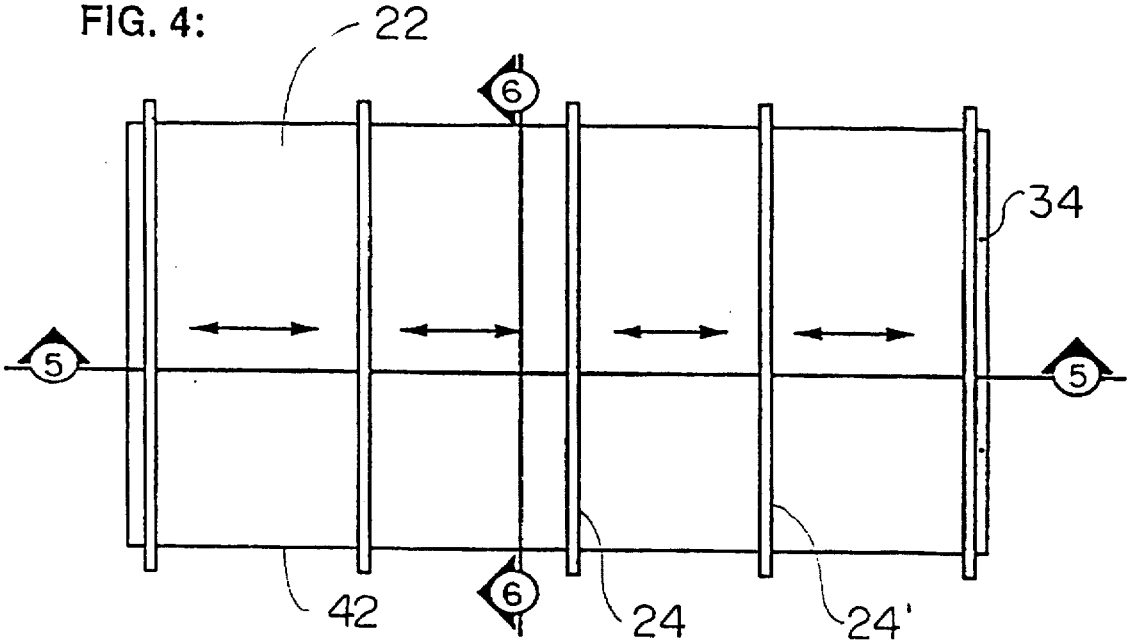
FIG. 4 is a top view indicating a displacement by arrows
Figure 6:
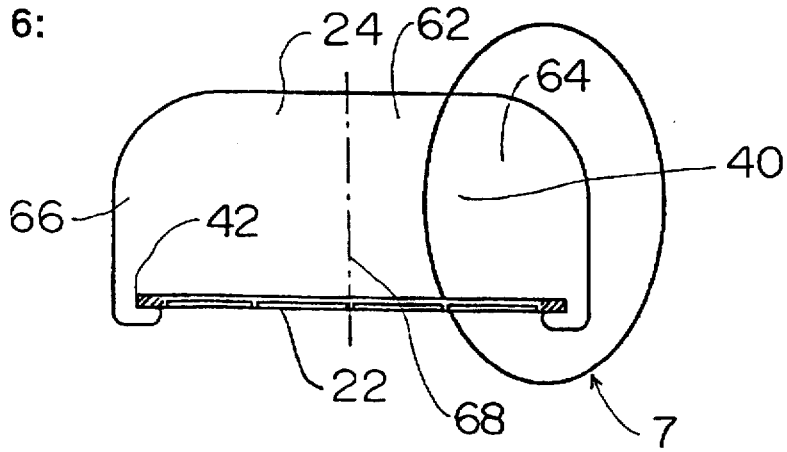

FIG. 6 a cut view according to line 6—6 of FIG. 4

Figure 7:
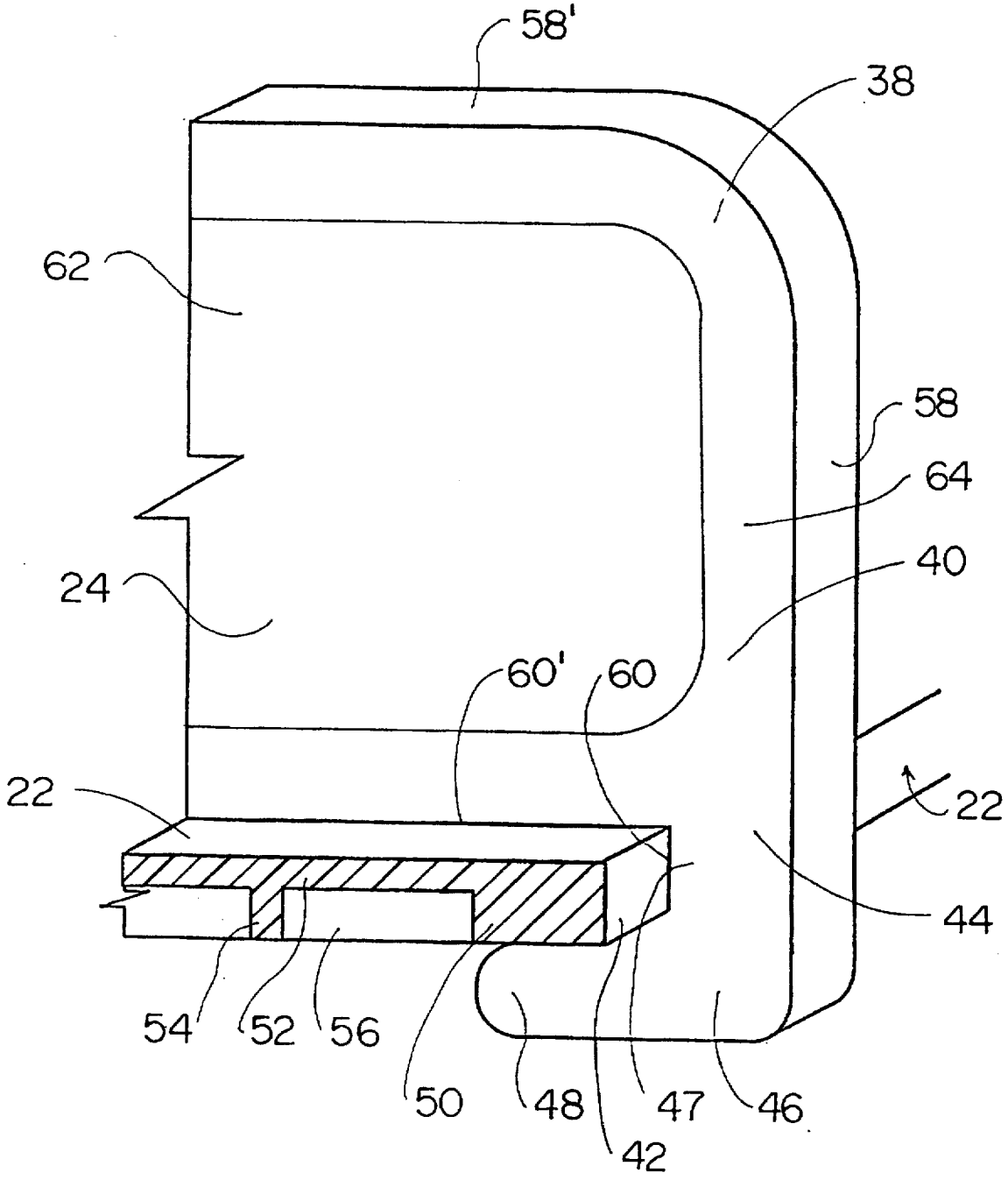

FIG. 7 is an enlarged view in the region of arrow 7 of FIG. 6

Figure 8:
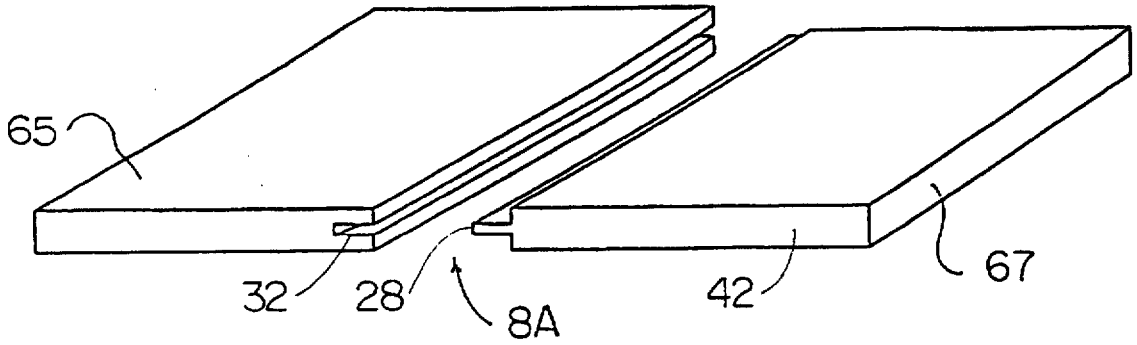

FIG. 8 is a perspective view of a joining system.

Figure 8A:
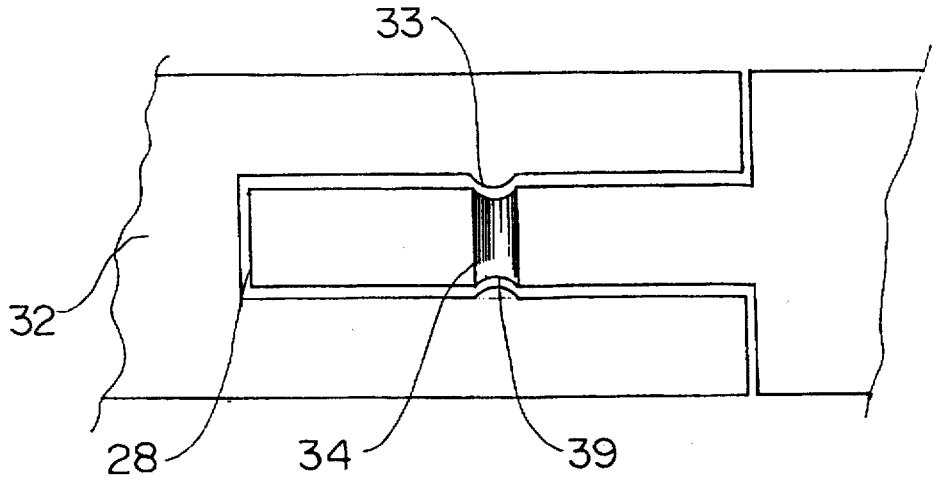

FIG. 8A is a face view enlarged in the region of arrow 8A of FIG. 8.

Figure 9:
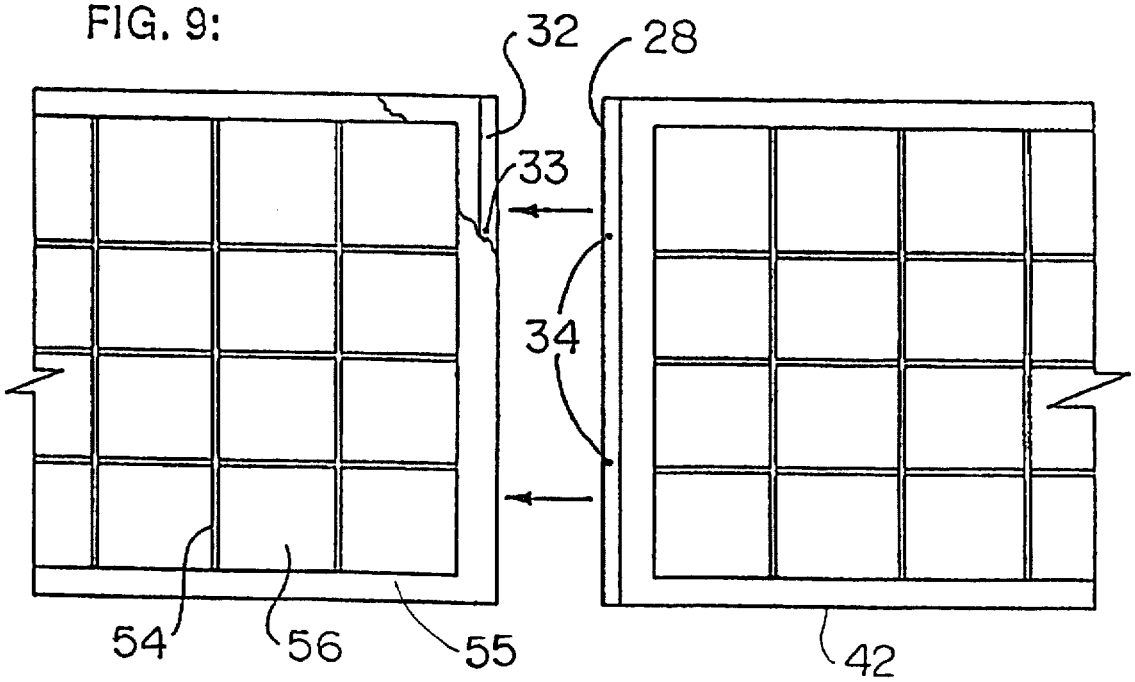

FIG. 9 is a bottom view according to line 9—9 of FIG. 8A

DESCRIPTION OF A PREFERRED EMBODIMENT

Figure 1:
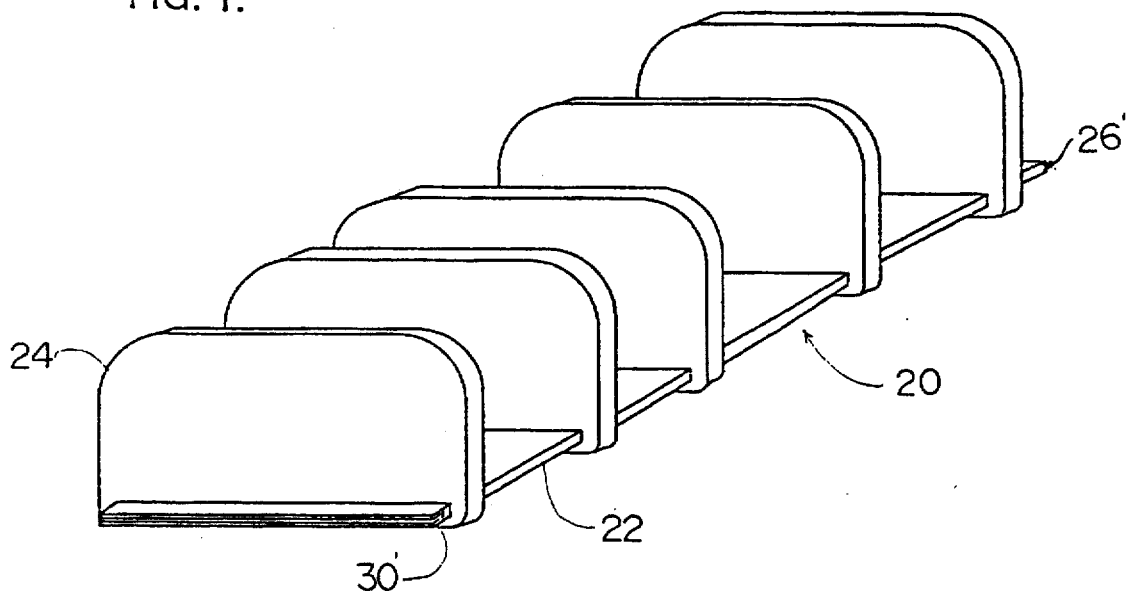
FIG. 1 is a perspective view of a storing unit

An embodiment of the invention is described in the following figures where the same characterising elements are identified by the same numbers and where one sees:

At FIG. 1, a storing unit 20 which is constituted of a floor support 22 according to a standard pattern and measuring approximately nine (9) inches by eighteen (18) inches and completed by five (5) dividers 24 ideally fabricated from moulded plastic, and measuring approximately five (5) inches in height by ten (10) inches in width. Also appear a leading edge 26 and a trailing edge 30.

Figure 1A:
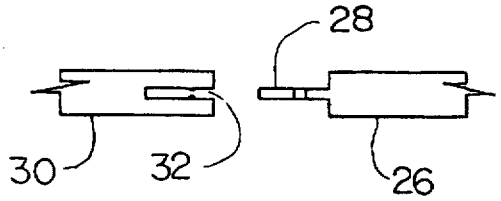
FIG. 1A is a face view of ends 26 and 30 of FIG. 1

FIG. 1A shows a detail of the way in which a leading edge 26' is ready for insertion into a trailing edge 30'. The leading edge 26' has a projecting part forming a tenon 28. The trailing edge 30' has a corresponding hole forming a mortise 32.

Figure 2:
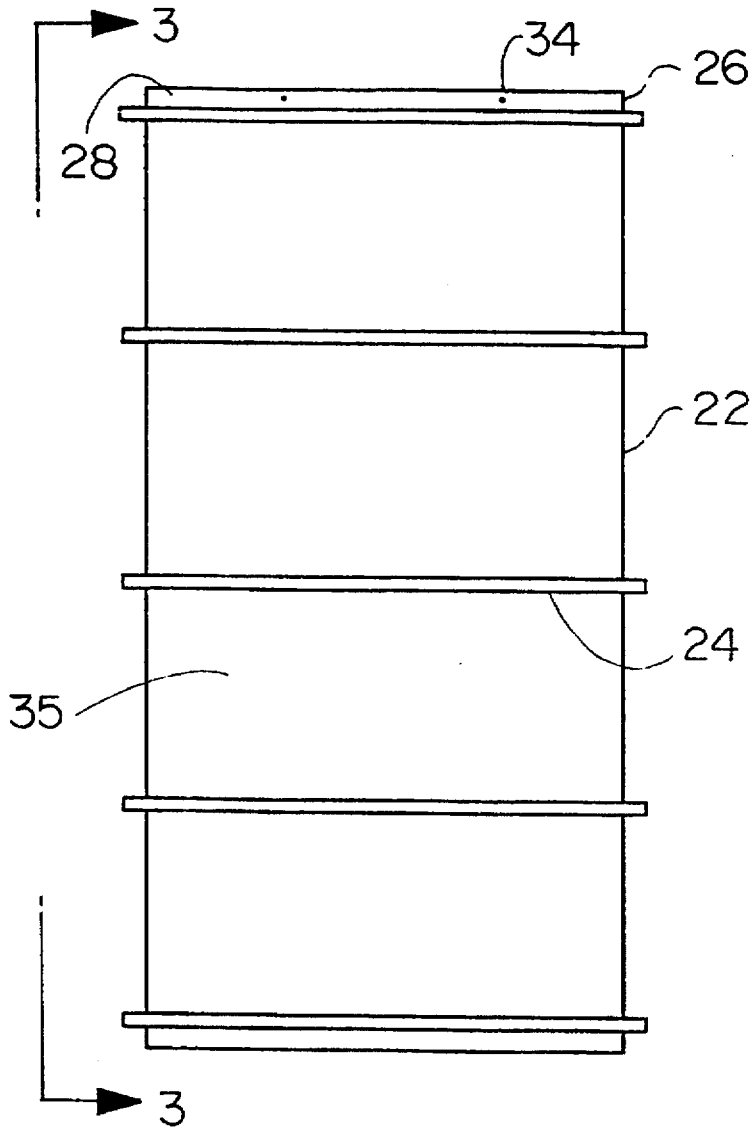
FIG. 2 is a top view of the storing unit of FIG. 1

At FIG. 2 one can see perforations 34 made on the tenon 28 at the leading edge 26 of the floor support 22, permitting then the vertical installation of the storage unit with the help of any fastening means. A storage area 35 is determined according to the position of a movable divider 24. The number of dividers 24 utilized depends on the size and number of articles to segregate.

Figure 3:
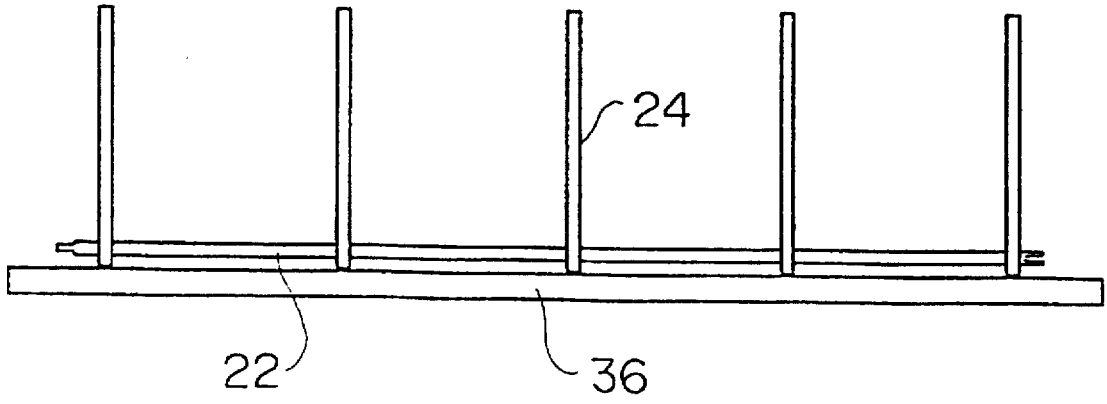
FIG. 3 is a side view according to line 3—3 of FIG. 2 s

FIG. 3 shows an example of the use of a certain number of dividers 24 according to the dimensions of articles such as handbags or simply according to the needs, for a horizontal installation of the floor support 22 on a shelf 36 or on a desk.

FIG. 4 shows a plan view of the storing unit with floor support 22 with a side edge 42 including a fixing perforation 34 for stabilizing into a fixed location, with the arrows indicating the many possible positions of the dividers 24.

Figure 5:
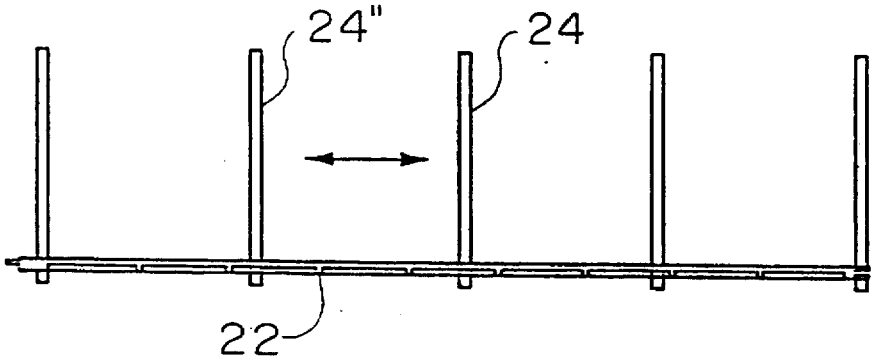
FIG. 5 is a side view indicating a displacement by arrows

FIG. 5 shows a lateral view illustrating by the arrows the lateral displacement of the dividers 24 horizontally along the floor support 22.

FIG. 6 shows a complete divider 24 seen from a cut and its design permitting to catch the side edge 42 of the floor support 22, thereby assuring the sliding function, and the adjustment. One can see here the design concept of the divider 24 having a C-shape: a web 62 which may take the form of a rectangle 40 or other forms in other embodiments, a first wing 64 and a second wing 66 and a central axis 68 located between the two wings.

FIG. 7 shows an enlarged detail of the movable divider 24 and of its floor support 22. The first wing 64, like the second wing 66, has a superior summit 38 and an inferior summit 44. The inferior summit 44 of the rectangle 40 has an L-shaped hook 46 with a trunk 47, being, when installed, perpendicular to the floor support 22, and a branch 48 parallel to the floor support 22, with the branch 48 of one L-shaped hook being oriented towards the branch 48' of a corresponding L-shaped hook. The floor support 22 has an end structure 50 to receive the L-shaped hook and more particularly to receive a resting face 60. The floor support 22 has a surface skin 52 provided with reinforcement transversal ribs 54, which leave a void 56, to maintain low weight, while the ribs maintain the strength. The contact area of the resting face 60 is as large as that of a wall end 58. The resting face 60 forms a contact surface around the floor support 22 and is of a wide size, ½" or more, for contact with the floor support 22. The wall end 58 forms a wide contour around the divider 24 to assure strength to the divider. The rest of the web 62 being thin, of the order of 1/16". The floor support 22 and the divider 24 are fabricated of smooth materials, ideally made of plastic, which permit the sliding, to adjust the divider 24 according to the storing space required for the object to store.

In the preferred embodiment the divider 24 has a rectangular web with a shorter side being a height h and a longer side being equivalent to a second width, slightly larger than the distance between the side edges, the height h being of the order of from 20 to 80% of the second width, the divider having a thickness e, the shorter side having two summits, one superior summit, rounded, and an inferior summit carrying an L-shaped hook, the L-shaped hook being of equal thickness e and oriented across the width, from side edge to side edge, a branch 48 of one of the L-shaped hook of the first wing 64 being opposite to the corresponding branch 48' of the second wing 66, each branch straddling one side edge of the support floor 22.

FIG. 8 demonstrates in detail the fitting system of the floor supports in a top perspective. A base structure has a length l, a first width w and a depth d, the length comprising a starting section 65 starting at a first end, an end section 67 ending at a second end, and a number of intermediary sections such as the support floor 22 of FIG. 1, each intermediary section comprising a trailing edge to, a leading edge 26 and two side edges 42, the leading edge 26 tightly inserted into the trailing edge 30 to reach profoundly a distance p into the corresponding trailing edge. The leading edge 26 and the trailing edge 30 may consist in a tenon 28 and a mortise 32, permitting to join end to end more storing units, be they to the vertical or to the horizontal, when one desires to increase the storing capacity.

FIG. 8A shows a detail of the joining by a tenon 28 into a mortise 32. One notices the perforation 34 and a beveled edge 39 which is receiving a protrusion 33 which is to snap into the perforation 34.

FIG. 9 presents a view from under two meeting floor supports and shows the way in which each intermediate floor support 22 can fit into a neighbour floor support and be immobilised, especially with the protrusion 33 to meet the perforation 34. One can see the solid section 55 of the side edge 42 and the reinforcing transversal ribs 54 spread across the floor support to permit strength, to resist the pull of the L-shaped hooks and to permit the use of a thin shell of plastic construction, leaving a void 56 for light weight, yet having sufficient strength. The center between the transversal ribs 54 could be emptied completely but for the inconvenient of offering some encroaching areas.

Method of operation: although as easy to install as a,b and c, the method involves the following steps:

- select a support floor 22, such as an intermediate part, select a divider 24 and introduce one divider at a time through the leading edge 26 and slide up to the trailing edge 30,
- add as many dividers 24 as needed,
- carefully slide along both sides using both hands to pull even,
- to hang on a wall utilise perforation 34,
- if necessary, add a front end, an end section, and other intermediate sections, enter tenon 28 into mortise 32 until the protrusion 33 snaps into the perforation 34,
- slide divider 24 over the joint so made, to lock into position.

It is well understood that other embodiments of the present invention, in reference to the annexed drawing may be constructed with other modifications and adaptations limited only by the scope of the following claims:

| Parts List | | | |
|---|---|---|---|
| 20 | storing unit | 47 | trunk |
| 22 | floor support | 48 | branch |
| 24 | divider | 50 | end structure |
| 26 | leading edge | 52 | surface skin |
| 28 | tenon | 54 | transversal ribs |
| 30 | trailing edge | 55 | solid section |
| 32 | mortise | 56 | void |
| 33 | protrusion | 58 | wall end |
| 34 | perforation | 60 | resting face |
| 35 | storage area | 62 | web |
| 36 | shelf | 64 | first wing |
| 38 | superior summit | 65 | starting section |
| 39 | beveled edge | 66 | second wing |
| 40 | rectangle | 67 | end section |
| 42 | side edge | 68 | central axis |
| 44 | inferior summit | | |
| 46 | L-shaped hook | | |

I claim:

1. A multipurpose modular storage unit for various articles of different shapes and configurations, comprising in combination:

a number of C-shaped dividers (24) comprising a web (62) and two wings (64), (66), said web having a central axis (68) passing centrally between said wings, said wings being provided with L-shaped hooks (46) protruding therefrom, each of said L-shaped hooks being oriented towards said central axis, a support floor (22) having two first and second ends and two side edges each side edge having a heavy section, said C-shaped dividers being installed transversely of said support floor with said L-shaped hooks slidingly straddling said heavy section of said side edges, said support floor comprises a length l, a first width w and a depth d, said length comprising a starting section starting at said first end, an end section ending at said second end, and a number of intermediary sections each intermediary sections comprising a trailing edge, a leading edge and said side edges, said leading edge of one intermediary section tightly inserted into said trailing edge of another intermediary section to reach profoundly a distance p into said corresponding trailing edge.

2. A storage unit such as defined in claim 1 wherein said leading edge is a tenon (28) and said trailing edge is a mortise (32), said tenon further comprising a perforation (34) with beveled edge (39) and said mortise comprising a protrusion (33) adapted to meet said bevelled edge (39) to lock matrix floor support (22) into position.

3. A storage unit as defined in claim 1 wherein said web is rectangular and has a height h and a second width slightly larger than said distance between said side edges, said height h being of the order of from 20 to 80% of said second width, said divider having a thickness e, said height being provided with two summits, one superior summit, rounded, and an inferior summit carrying said L-shaped hook, said L-shaped hook being of equal thickness e and oriented across said width, an inferior end of one of said L-shaped hooks being opposite to said corresponding inferior end of another L-shaped hooks, for gripping both of said side edges.

4. A storage unit for different articles of uneven shapes and sizes, such as for purses and handbags, said storage unit comprising a floor support having a uniform thickness, a number of adjustable dividers provided with L-shaped extensions disposed perpendicularly of said floor support and having an aperture embracing tightly, said floor support with a tolerance permitting to slide manually along said floor support a distance according to said shape of articles to store, said floor support, in order to permit installation vertically for flat articles such as towels, sandals, stockings, documents, office file wrapper, is perforated at extremities thereof to hang said floor support vertically against resting means such as a wall, the dividers being horizontal, to support said flat articles, said L-shaped extensions being forced against said wall and the cantilever of said dividers causing the securing of said divider into a position, without sliding.

5. A storage unit such as defined in claim 4 wherein said extremity of one floor support can fit into another floor support extremity for joining two or more storing units end to end, be they vertically or horizontally set, to augment the capacity of storing.

6. A storage unit such as defined in claim 1 wherein said floor support is made of a relatively light and slippery material, notably of moulded plastic or light material provided with means of reinforcement and with sides of a certain depth to be seized by said aperture of said L-shaped extension.

7. A storage unit such as defined in claim 6 wherein said material is relatively rigid but equally slippery, permitting said dividers to be adjustable by a simple manual pressure one way or another.

8. A storage unit such as defined in claim 7 wherein said dividers are of a size having approximately five (5) inches in height by ten (10) inches in width.

9. An assembly method for a multipurpose modular support unit comprising the following steps:

select a support floor (22) having a leading edge and a trailing edge, a mortise at one end and a tenon at the other end as an intermediate part, select a divider (24) and introduce said divider through a leading edge (26) and slide up to a trailing edge (30) of said floor support, add as many of said dividers (24) as needed, carefully slide along both sides of said divider using both hands to pull said divider evenly, add a front end, an end section (67), and other intermediate sections enter a tenon (28) of one floor support into a mortise (32) until a protrusion (33) snaps into a perforation (34), of another floor support forming a joint, slide said divider over a joint so made to lock in position.

10. The assembly method of claim 9 including a further step of hanging said assembly on a wall by perforations (34) in said floor support.

* * * * *